US008492639B2

(12) United States Patent
Saino

(10) Patent No.: US 8,492,639 B2
(45) Date of Patent: Jul. 23, 2013

(54) AUDIO PROCESSING APPARATUS AND METHOD

(75) Inventor: Keijiro Saino, Hamamatsu (JP)

(73) Assignee: Yamaha Corporation, Hamamtsu-shi (JP)

( * ) Notice: Subject to any disclaimer, the term of this patent is extended or adjusted under 35 U.S.C. 154(b) by 223 days.

(21) Appl. No.: 12/960,310

(22) Filed: Dec. 3, 2010

(65) Prior Publication Data

US 2011/0132179 A1 Jun. 9, 2011

(30) Foreign Application Priority Data

Dec. 4, 2009 (JP) ..... 2009-276470

(51) Int. Cl.
*G10H 1/02* (2006.01)
*G10H 7/00* (2006.01)

(52) U.S. Cl.
USPC ..... 84/629

(58) Field of Classification Search
USPC ..... 84/629
See application file for complete search history.

(56) References Cited

U.S. PATENT DOCUMENTS 5,412,152 A 5/1995 Kageyama et al.
5,536,902 A 7/1996 Serra et al.
6,169,241 B1 1/2001 Shimizu
6,255,576 B1 7/2001 Suzuki et al.
6,965,069 B2 * 11/2005 Le-Faucheur et al. ..... 84/659
2003/0094090 A1 5/2003 Tamura et al.

FOREIGN PATENT DOCUMENTS

EP 1 239 463 A2 9/2002
EP 1 239 463 A3 9/2002
EP 1 239 463 B1 9/2002
EP 1 742 200 A1 1/2007
JP 07-325583 A 12/1995
JP 2002-073064 A 3/2002

OTHER PUBLICATIONS

Yamada, T. et al. (May 21, 2009). "Vibrato Modeling for HMM-based Singing Voice Synthesis," *IPSJ SIG Technical Report* 2009(MUS-80-5):1-6.
European Search Report mailed Mar. 24, 2011, for EP Application No. 10193423.0, nine pages.

* cited by examiner

*Primary Examiner* — Jeffrey Donels
(74) *Attorney, Agent, or Firm* — Morriston & Foerster LLP

(57) ABSTRACT

Phase setting section sets virtual phases in a frequency series of an audio signal. Unit wave extraction section extracts, from the frequency series, a unit wave of one cyclic period defined by the set virtual phases, for each of a plurality of time points. First generation section generates velocity information corresponding to a degree of compression/expansion, to a predetermined length, of the unit wave. Second generation section generates shape information indicative of a shape of a frequency spectrum of the unit wave having been adjusted. Variation component impartment section generates a variation component by use of the velocity information and shape information generated for the individual time points.

13 Claims, 6 Drawing Sheets

AUDIO PROCESSING APPARATUS AND METHOD

BACKGROUND

The present invention relates to an audio signal processing technique.

Heretofore, there have been proposed techniques for imparting a vibrato component to an audio signal obtained by picking up a singing voice. For example, Japanese Patent Application Laid-open Publication No. HEI-7-325583 (corresponding to U.S. Pat. No. 5,536,902) (hereinafter referred to as "patent literature 1") discloses a technique that imparts a desired audio signal with a sine wave adjusted in amplitude and cyclic period in accordance with a depth and velocity of a vibrato component extracted from an audio signal. Further, Japanese Patent Application Laid-open Publication No. 2002-73064 (hereinafter referred to as "patent literature 2") discloses extracting a vibrato component from a singing voice and imparts a vibrato to an audio signal on the basis of the extracted vibrato component. Furthermore, "Vibrato Modeling For Synthesizing Vocal Voice Based On HMM", by Yamada Tomohiko and four others, Study Report of Information Processing Society of Japan, May 21, 2009, Vol. 2009-MUS-80, No. 5 (hereinafter referred to as "nonparent literature 1") discloses a technique for imparting a synthesized sound of a singing voice with a vibrato component approximated by a sine wave.

However, with the prior art techniques disclosed in patent literature 1 and non-patent literature 1, where a vibrato component is approximated by a simple sine wave, would present that problem that it is difficult to impart a natural vibrato component that is generally the same as that in an actual voice. The prior art techniques would also present a problem in imparting a variation component of other character elements than a pitch.

SUMMARY OF THE INVENTION

In view of the foregoing, it is an object of the present invention to generate a variation component that allows a character element of an audio signal to vary in an auditorily natural manner.

In order to accomplish the above-mentioned object, a first aspect of the present invention provides an improved audio processing apparatus, which comprises: a phase setting section which sets virtual phases in a time series of character values representing a character element of an audio signal; a unit wave extraction section which extracts, from the time series of character values, a plurality of unit waves demarcated in accordance with the virtual phases set by the phase setting section; and an information generation section which generates, for each of the unit waves extracted by the unit wave extraction section, unit information indicative of a character of the unit wave. In the audio processing apparatus of the present invention, a set of a plurality of unit information for individual time points (i.e., variation information) (each of the unit information is indicative of a character of a unit wave corresponding to one cyclic period of a time series of character values representing a character element of an audio signal) is generated as information indicative of variation of the character element of an audio signal. In this way, the present invention can generate an audio signal where the character element varies in an auditorily natural matter, as compared to the technique where variation of a tone pitch is approximated with a sine wave as disclosed in patent literature 1 and non-patent literature 1.

Note that the term "virtual phases" is used herein to refer to phases in a case where the time series of character values is assumed to represent a periodic waveform (e.g., sine wave). For example, the phase setting section sets virtual phases of individual extreme value points, included in the time series of character values, to predetermined values, and calculates a virtual phase of each individual time point located between the successive extreme value points by performing interpolation between the virtual phases of the extreme value points.

In a preferred implementation, the audio processing apparatus of the present invention further comprises a phase correction section which corrects the phases of the unit waves, extracted by the unit wave extraction section, so that the unit waves are brought into phase with each other, and the information generation section generates the unit information for each of the unit waves having been subjected to phase correction by the phase correction section. Because the unit waves extracted by the unit wave extraction section are adjusted or corrected to be in phase with each other (i.e., corrected so that the initial phases of the individual unit waves all become a zero phase), this preferred implementation can, for example, readily synthesize (add) a plurality of the unit information, as compared to a case where the unit waves indicated by the individual unit information differ in phase.

In a preferred implementation, the audio processing apparatus of the present invention further comprises a time adjustment section which compresses or expands each of the unit waves extracted by the unit wave extraction section, and wherein the information generation section generates the unit information for each of the unit waves having been subjected to compression or expansion by the time adjustment section. Because the unit waves extracted by the unit wave extraction section are adjusted to a predetermined length, this preferred implementation can, for example, readily synthesize (add) a plurality of the unit information, as compared to a case where the unit waves indicated by the individual unit information differ in time length.

In the aforementioned preferred implementation which includes the time adjustment section, the information generation section includes a first generation section which, for each of the unit waves, generates, as the unit information, velocity information indicative of a character value variation velocity in the time series of character values in accordance a degree of the compression or expansion by the time adjustment section. Because velocity information indicative of a variation velocity of the character element of the audio signal is generated as the unit information, this preferred implementation can advantageously generate a variation component having the variation velocity of the character element faithfully reflected therein. Further, because the velocity information is generated in accordance a degree of the compression or expansion by the time adjustment section, the preferred implementation can reduce a load involved in generation of the velocity information, as compared to a case where the velocity information is generated independently of the compression/expansion by the time adjustment section.

In a further preferred implementation, the information generation section includes a second generation section which, for each of the unit waves, generates, as the unit information, shape information indicative of a shape of a frequency spectrum of the unit wave. Because shape information indicative of a shape of a frequency spectrum of the unit wave extracted from the audio signal is generated as the unit information, this preferred implementation can advantageously generate a variation component having a variation shape of the character element faithfully reflected therein. Further, if the second generation section is constructed to generate, as the shape information, a series of coefficients within a predetermined low frequency region of the frequency spectrum of the unit wave (while ignoring a series of coefficients within a predetermined high frequency region of the frequency spectrum), the preferred implementation can also advantageously reduce a necessary capacity for storing the unit information.

According to a second aspect of the present invention, there is provided an improved audio signal processing apparatus, which comprises: a storage section which stores a set of a plurality of unit information indicative of respective characters of a plurality of unit waves extracted from a time series of character values, representing a character element of an audio signal, in accordance with virtual phases set in the time series, the unit information each including velocity information to be used for control to compress or expand a time length of a corresponding one of the unit waves, and shape information indicative of a shape of a frequency spectrum of the corresponding unit wave; a variation component generation section which generates a variation component, corresponding to the time series of character values, from the set of the unit information stored in said storage section; and a signal generation section which impart the variation component, generated by said variation component generation section, to a character element of an input audio signal. In the audio signal processing apparatus of the present invention thus arranged, a variation component is generated from a set of a plurality of the unit information extracted from the time series of character values of the audio signal, and an audio signal imparted with such a variation component is generated. Thus, the present invention can generate an audio signal where the character element varies in an auditorily natural matter, as compared to the technique where variation of a tone pitch is approximated with a sine wave as disclosed in patent literature 1 and non-patent literature 1.

The present invention may be constructed and implemented not only as the apparatus invention as discussed above but also as a method invention. Also, the present invention may be arranged and implemented as a software program for execution by a processor such as a computer or DSP, as well as a storage medium storing such a software program. The software program may be installed into a computer of a user by being stored in a computer-readable storage medium and then supplied to the user in the storage medium, or by being delivered to the computer via a communication network.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which.

DETAILED DESCRIPTION

A. First Embodiment

Figure 1:
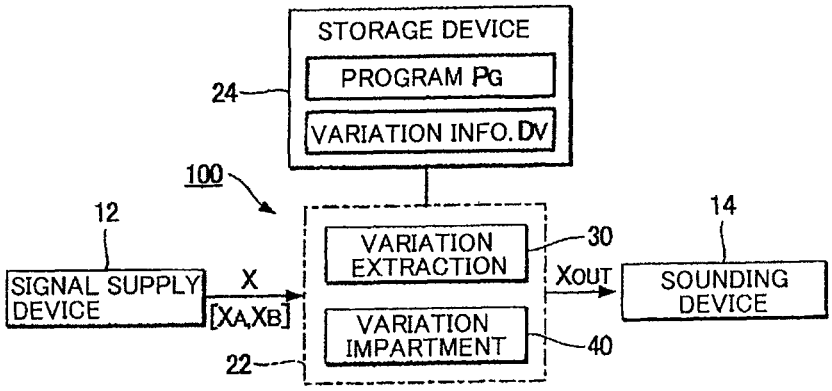
FIG. 1 is a block diagram of an audio processing apparatus according to a first embodiment of the present invention.

FIG. 1 is a block diagram of an audio processing apparatus 100 according to a first embodiment of the present invention. A signal supply device 12 and a sounding device 14 are connected to the audio processing apparatus 100. The signal supply device 12 supplies audio signals X (which includes an audio signal $X_A$ to be analyzed and/or an audio signal $X_B$ to be reproduced) indicative of waveforms of sounds (voices and tones). As the signal supply device 12 can be employed, for example, a sound pick up device that picks up an ambient sound and generates an audio signal X (i.e., $X_A$ and/or $X_B$) based on the picked-up sound, a reproduction device that obtains an audio signal X from a storage medium and outputs the obtained audio signal X to the audio processing apparatus 100, or a communication device that receives an audio signal X from a communication network and outputs the received audio signal X to the audio processing apparatus 100.

As shown in FIG. 1, the audio processing apparatus 100 is implemented by a computer system comprising an arithmetic processing device 22 and a storage device 24. The storage device 24 stores therein programs PG for execution by the arithmetic processing device 22 and data (e.g., later-described variation information DV) for use by the arithmetic processing device 22. Any desired conventional-type recording or storage medium, such as a semiconductor storage medium or magnetic storage medium, or a combination of a plurality of conventional-type storage media may be used as the storage device 24. In one preferred implementation, audio signals X (i.e., the audio signal $X_A$ to be analyzed and/or the audio signal $X_B$ to be reproduced) may be prestored in the storage device 24 to be supplied for analysis and/or reproduction.

The arithmetic processing device 22 performs a plurality of functions (variation extraction section 30 and variation impartment section 40) for processing an audio signal, by executing the programs PG stored in the storage device 24. In an alternative, the plurality of functions of the arithmetic processing device 22 may be distributed on a plurality of integrated circuits, or a dedicated electronic circuit (DSP) may perform the plurality of functions.

The variation extraction section 30 generates variation information DV characterizing variation over time of a fundamental frequency $f_0$ (namely, vibrato) of an audio signal XA and stores the thus generated variation information DV into the storage device 24. The variation impartment section 40 generates an audio signal $X_{OUT}$ by imparting a variation component of the fundamental frequency $f_0$, indicated by the variation information DV generated by the variation extraction section 30, to an audio signal $X_B$. The sounding device (e.g., speaker or headphone) 14 radiates the $X_{OUT}$ generated by the variation impartment section 40. The following describe specific examples of the variation extraction section 30 and variation impartment section 40.

A-1: Construction and Behavior of the Variation Extraction Section 30

Figure 2:
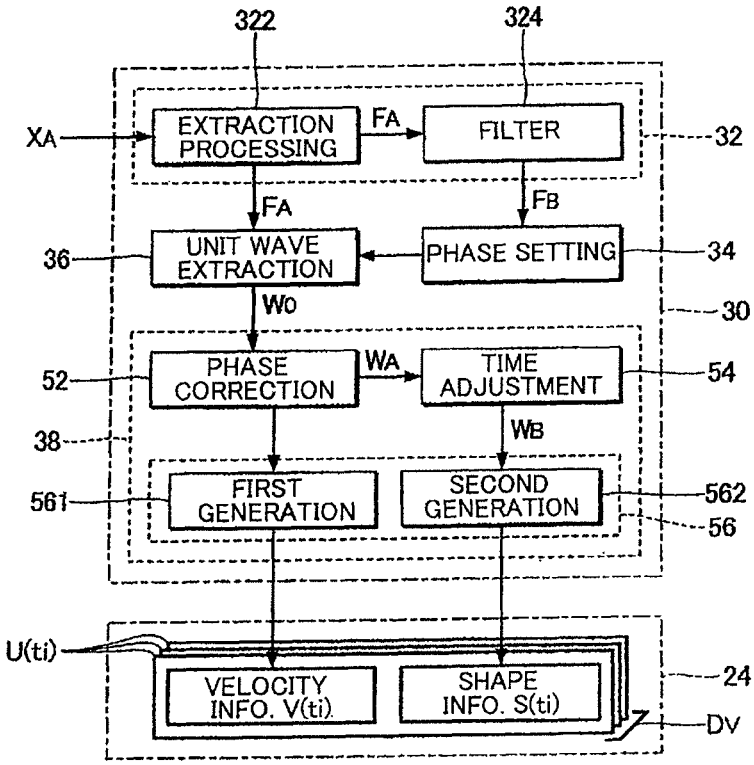
FIG. 2 is a block diagram of a variation extraction section provided in the audio processing apparatus.

FIG. 2 is a block diagram of the variation extraction section 30. As shown, the variation extraction section 30 includes a character extraction section 32, a phase setting section 34, a unit wave extraction section 36 and a unit wave processing section 38. The character extraction section 32 is a component that extracts a time series of fundamental frequencies $f_0$ (hereinafter referred to as "frequency series") of an audio signal $X_A$, and that includes an extraction processing section 322 and a filter section 324. The extraction processing section 322 sequentially extracts the fundamental frequencies $f_0$ of the audio signal $X_A$ for individual time points ti as an example time series of character values indicative of a character element of the audio signal, to thereby generate a frequency series $F_A$ (i=1, 2, 3, . . . ) as shown in (A) of FIG. 3. The filter section 324 is a low-pass filter that suppresses high-frequency components of the frequency series $F_A$, generated by the extraction processing section 322, to thereby generate a frequency series $F_B$ as shown in (B) of FIG. 3. As shown in (B) of FIG. 3, the individual fundamental frequencies $f_0$ of the frequency series $F_B$ vary generally periodically along the time axis. Note, alternatively, that the frequency series $F_A$ and/or $F_B$ may be prestored in the storage device 24, and if so, the variation extraction section 30 may be omitted.

Figure 3:
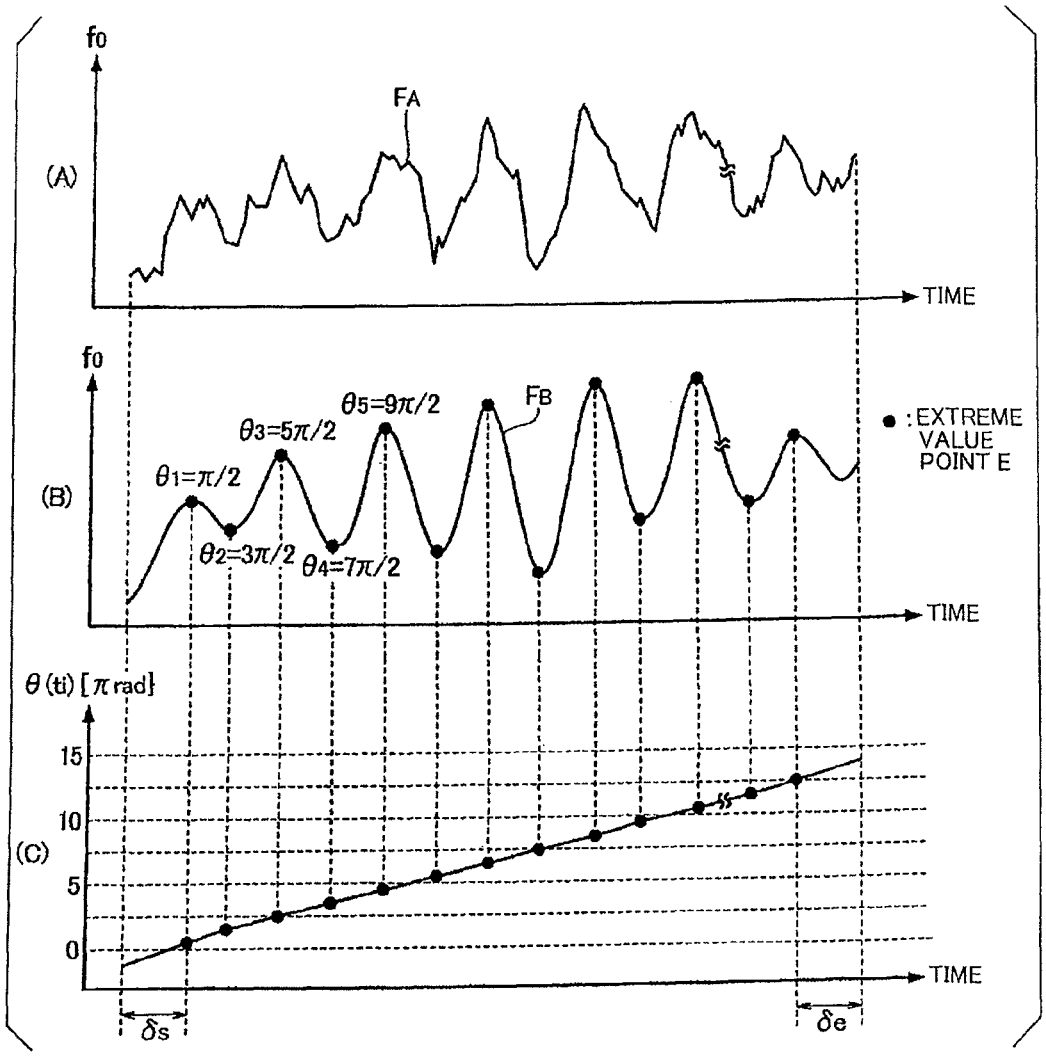
FIG. 3 is a diagram explanatory of behavior of a character extraction section and phase setting section provided in the audio processing apparatus.

The phase setting section 34 of FIG. 2 sets a virtual phase θ(ti) for each of a plurality of time points ti of the frequency series $F_B$ generated by the character extraction section 32. The virtual phase θ(ti) represents a phase at the time point ti, assuming that the frequency series $F_B$ is a periodic waveform. (C) of FIG. 3 shows a time series of the virtual phases θ(ti) set for the individual time points ti. The following describe in detail an example manner in which the virtual phases θ(ti) are set.

First, the phase setting section 34 sequentially sets virtual phases θ(ti) for the individual time points ti, corresponding to individual extreme value points E of the frequency series $F_B$, to predetermined phases θm (m are natural numbers), as shown in (B) of FIG. 3. Each of the extreme value points E is a time point of a local peak or dip in the frequency series $F_B$. Such extreme value points E are detected using any desired one of the conventionally-known techniques. A phase θm to be imparted to an m-th extreme value point E in the frequency series $F_B$ can be expressed as $[(2m-1)/2]\cdot\pi$ (i.e., θm=n/2, 3π/2, 5π/2, . . . ). Whereas (B) of FIG. 3 shows a case where the first extreme value point is a peak, the instant embodiment may alternatively employ a structural arrangement where the first extreme value point is a dip so that the setting of the phases θm starts with "−π/2" (i.e., θm=−π/2, π/2, 3π/2, . . . ).

Second, the phase setting section 34 calculates a virtual phase θ(ti) for each of the time points ti other than the extreme value points E in the frequency series FB, by performing interpolation between virtual phases θ(ti) (θ(ti)=θm) at extreme value points E located immediately before and after the time points ti in question. More specifically, the phase setting section 34 calculates a virtual phase θ(ti) for each of the time points ti located between the m-th extreme value point E and the (m+1)-th extreme value point E, by performing interpolation between the virtual phase θ(ti) (=θm) at the m-th extreme value point E and the virtual phase θ(ti) (=θm+1) at the (m+1)-th extreme value point E. Such interpolation between the virtual phases θ(ti) may be performed using any suitable one of the conventionally-known techniques (typically, the linear interpolation).

A virtual phase θ(ti) for each time point ti within a portion δs preceding the first extreme value point E of the frequency series $F_B$ is calculated through extrapolation between virtual phases θ(ti) at extreme value points E (e.g., first and second extreme value points E) near the portion δs. Similarly, a virtual phase θ(ti) at each time point ti within a portion δe succeeding the last extreme value point E of the frequency series $F_B$ is calculated through extrapolation between virtual phases θ(ti) at extreme value points E near the portion δe. The extrapolation between the virtual phases θ(ti) may be performed using any suitable one of the conventionally-known techniques (e.g., the linear interpolation). Through the aforementioned procedure, a virtual phase θ(ti) is set for each time point ti (i.e., for each of the extreme value points E and time points other than the extreme value points E) of the frequency series $F_A$.

Intervals between the successive extreme value points E vary in accordance with a variation velocity of the fundamental frequency $f_0$ (i.e., vibrato velocity) of the audio signal $X_A$. Thus, as seen from (C) of FIG. 3, a temporal variation rate (i.e., variation rate over time) of the virtual phases θ(ti), namely, a slope of a line indicative of the virtual phases θ(ti), changes from moment to moment as the time passes. Namely, as the vibrato velocity of the audio signal $X_A$ increases (i.e., as a cyclic period of the variation of the fundamental frequency $f_0$ per unit time decreases), the temporal variation rate of the virtual phases θ(ti) increases.

Figure 4:
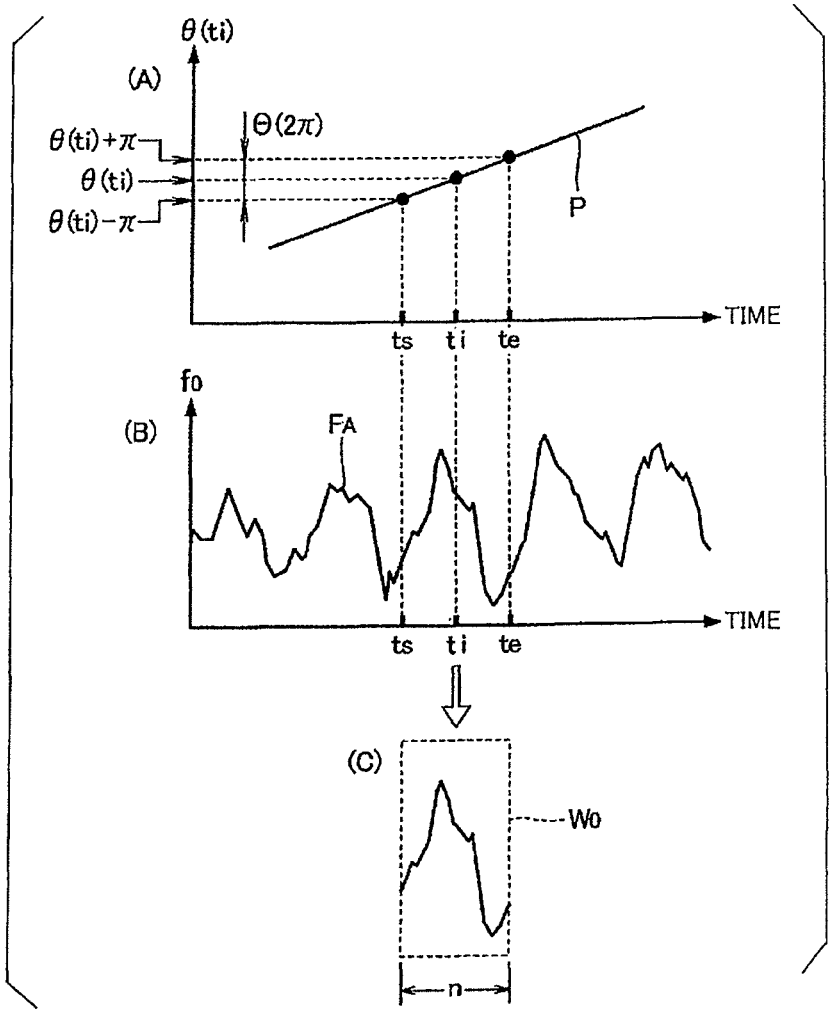
FIG. 4 is a schematic view explanatory of behavior of a unit wave extraction section provided in the audio processing apparatus.

The unit wave extraction section 36 of FIG. 2 extracts, for each of the time points ti on the time axis, a wave Wo of one cyclic period (hereinafter referred to as "unit wave"), including the time point ti, from the frequency series FA generated by the extraction processing section 322 of the character extraction section 32. FIG. 4 is a schematic view explanatory of an example manner in which a unit wave Wo corresponding to a given time point ti is extracted by the unit wave extraction section 36. Namely, as shown in (A) of FIG. 4, the unit wave extraction section 36 defines or demarcates a portion Θ of one cyclic period extending over a width of 2π and centering at the virtual phase θ(ti) set for the given time point ti. Then, the unit wave extraction section 36 extracts, as a unit wave Wo, a portion of the frequency series $F_A$ which corresponds to the demarcated portion Θ, as shown in (B) and (C) of FIG. 4. Namely, of the frequency series FA, a portion between a time point is for which a virtual phase [θ(ti)−π] has been set and a time point to for which a virtual phase θ[(ti)+π] has been set is extracted as a unit wave Wo corresponding to the given time point ti.

Because the temporal variation rate (i.e., variation rate over time) of the virtual phases θ(ti) varies in accordance with the vibrato velocity of the audio signal $X_A$ as noted above, the number of samples n, constituting the unit wave Wo, can vary every time point ti in accordance with the vibrato velocity of the audio signal $X_A$. More specifically, as the vibrato velocity of the audio signal $X_A$ increases (namely, as the intervals between the successive extreme value points E decreases), the number of samples n in the unit wave Wo decreases.

Figure 5:
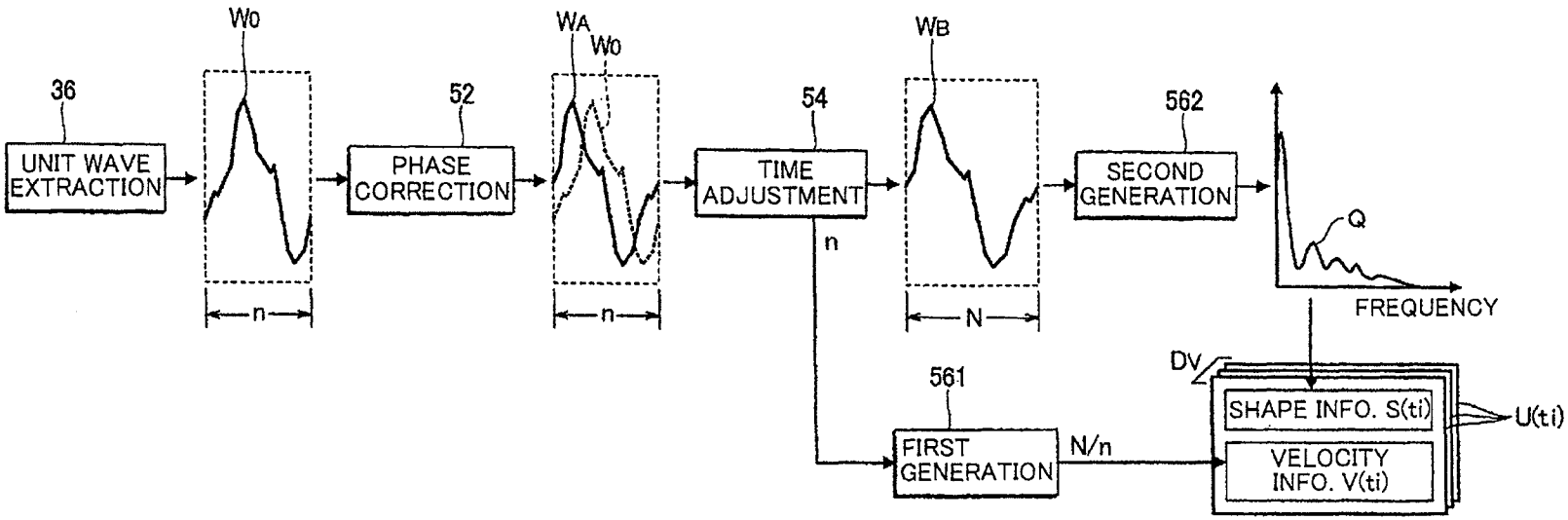
FIG. 5 is a block diagram explanatory of behavior of an information generation section provided in the audio processing apparatus.

The unit wave processing section 38 of FIG. 2 generates, for each of the unit waves Wo extracted by the unit wave extraction section 36 for the individual time points ti, unit information U(ti) indicative of a character of the unit wave Wo. A set of a plurality of such unit information U(ti) generated for the different time points ti are stored into the storage device 24 as variation information DV. As shown in FIG. 2, the unit wave processing section 38 includes a phase correction section 52, a time adjustment section 54 and an information generation section 56. The phase correction section 52 and time adjustment section 54 adjusts the shape of each unit wave Wo, and the information generation section 56 generates unit information U(ti) (variation information DV) from each of the unit waves Wo. FIG. 5 is a block diagram explanatory of behavior of the unit wave processing section 38.

Figure 6:
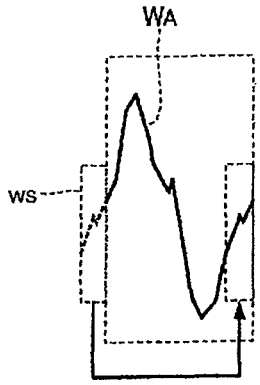
FIG. 6 is a diagram explanatory of behavior of a phase correction section provided in the audio processing apparatus.

As shown in FIG. 5, the phase correction section 52 generates a unit wave $W_A$ for each of the time points ti by correcting the unit wave Wo extracted by the unit wave extraction section 36 for the time point ti, so that the unit waves Wo are brought into phase with each other. More specifically, as shown in FIG. 5, the phase correction section 52 phase-shifts each of the unit waves Wo in the time axis direction so that the initial phase of each of the unit waves Wo becomes a zero phase. For example, as shown in FIG. 6, the phase correction section 52 shifts a leading end portion ws of the unit wave Wo to the trailing end of the unit wave Wo, to thereby generate a unit wave $W_A$ having a zero initial phase. In an alternative, the phase correction section 52 may generate such a unit wave $W_A$ having a zero initial phase, by shifting a trailing end portion of the unit wave Wo to the leading end of the unit wave Wo. The aforementioned operations are performed for each of the unit waves Wo, so that the unit waves $W_A$ for the individual time points ti are adjusted to the same phase.

As shown in FIG. 5, the time adjustment section 54 of FIG. 2 compresses or expands each of the unit waves WA, having been adjusted by the phase correction section 52, into a common or same time length (i.e., same number of samples) N, to thereby generate a unit wave WB. Because the information generation section 56 (i.e., second generation section 562) performs discrete Fourier transform on the unit wave WB as will be later described, it is preferable that the time length N be set at a power of two (e.g., N=64). The compression/expansion of the unit waves WA (i.e., generation of the unit wave WB) may be performed using any suitable one of the conventionally-known techniques (such as a process for linearly compressing or expanding the unit wave WA).

As further shown in FIG. 2, the information generation section 56 includes a first generation section 561 that generates velocity information V(ti) every time point ti, and the second generation section 562 that generates shape information S(ti) every time point ti. Unit information U(ti) including such velocity information V(ti) and shape information S(ti), generated for the individual time points ti, are sequentially stored into the storage device 24 as variation information DV.

The first generation section 561 generates velocity information V(ti) from each of the unit wave WA having been processed by the phase correction section 52 or from each of the unit waves WO before processed by the phase correction section 52. The velocity information V(ti) is representative of an index value that functions as a measure of the vibrato velocity of the audio signal XA. More specifically, the first generation section 561 calculates, as the velocity information V(ti), a relative ratio between the number of samples n of the unit wave Wo at the time point ti and the number of samples N of the unit wave WB having been adjusted by the time adjustment section 54 (N/n), as shown in FIG. 5. As noted above, as the vibrato velocity of the audio signal XA increases, the number of samples n in the unit wave Wo decreases. Thus, as the vibrato velocity of the audio signal XA increases, the velocity information V(ti) (=N/n) takes a greater value.

The second generation section 562 of FIG. 2 generates shape information S(ti) from each of the unit waves WB having been adjusted by the time adjustment section 54. As seen from FIG. 5, the shape information S(ti) is a series of numerical values indicative of a shape of a frequency spectrum (complex vector) Q of the unit wave WB. More specifically, the second generation section 562 generates such a frequency spectrum Q by performing discrete Fourier transform on the unit wave WB (N samples), and extracts a series of a plurality of coefficient values (at N points), constituting the frequency spectrum Q, as the shape information S(ti). In an alternative, a series of numerical values indicative of an amplitude spectrum or power spectrum of the unit wave WB may be used as the shape information S(ti).

As understood from the foregoing, the shape information S(ti) is representative of an index value characterizing the shape of the unit wave Wo of one cyclic period, corresponding to a given time point ti, of the frequency series FA. Namely, a unit wave WC generated by the inverse Fourier transform of the shape information S(ti) (although the unit wave WC is generally identical to the unit wave WB, it is indicated by a different reference character from the unit wave WB for convenience of description) has a waveform (different in shape from the unit wave Wo) having reflected therein the shape of the unit wave Wo, corresponding to the given time point ti, of the frequency series FA. For example, a maximum value of the coefficient values of the frequency spectrum Q indicated by the shape information S(ti) represents a vibrato depth (i.e., variation amplitude of the fundamental frequency $f_0$) in the audio signal XA. The foregoing are the construction and behavior of the variation extraction section 30.

A-2: Construction and Behavior of the Variation Impartment Section 40

Figure 7:
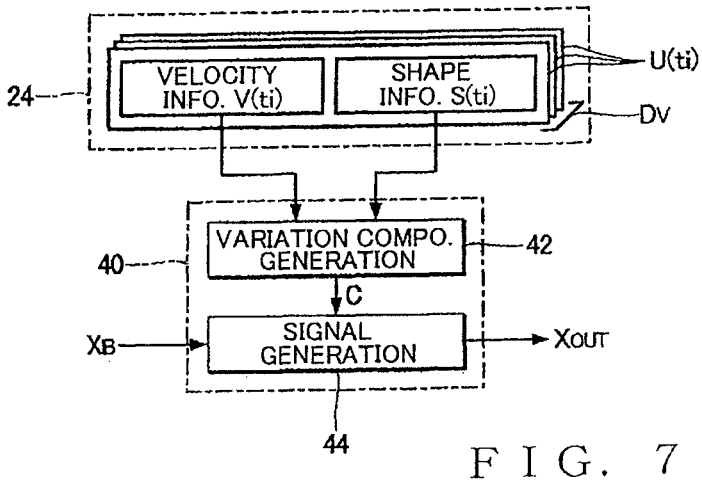
FIG. 7 is a block diagram of a variation impartment section provided in the audio processing apparatus.

The variation impartment section 40 of FIG. 1 imparts a vibrato to an audio signal (i.e., the audio signal XB to be reproduced) by use of the unit information U(ti) created for each of the time points ti through the above-described procedure. FIG. 7 is a block diagram of the variation impartment section 40. The variation impartment section 40 includes a variation component generation section 42 and a signal generation section 44. The variation component generation section 42 generates a variation component of the fundamental frequency $f_0$ (i.e., vibrato component of the audio signal XA) C by use of the variation information DV. The signal generation section 44 generates an audio signal $X_{OUT}$ by imparting the variation component C to the audio signal XB supplied from the signal supply device 12.

Figure 8:
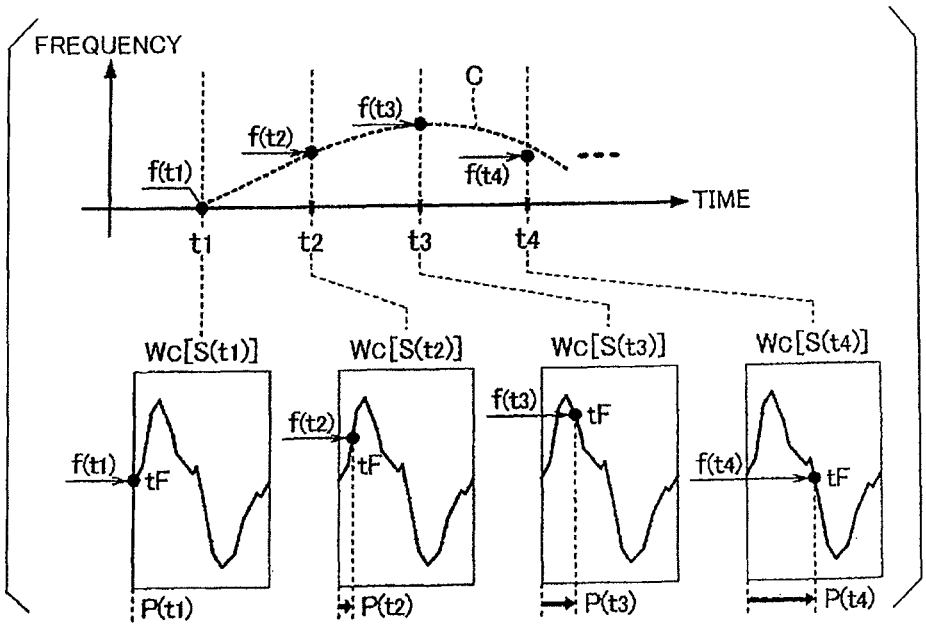
FIG. 8 is a view explanatory of behavior of the variation impartment section.

FIG. 8 is a view explanatory of behavior of the variation component generation section 42. As shown in FIG. 8, the variation component generation section 42 sequentially calculates a frequency (fundamental frequency (pitch)) f(ti) for each of the plurality of time points ti on the time axis. A time series of the frequencies f(ti) for the individual time points constitutes a variation component C. Each of the frequencies f(ti) of the variation component C represents a frequency at a given time point tF of the unit wave WC (fundamental frequencies $f_0$ of N samples) represented by the shape information S(ti) for the time point ti. Namely, the shape of the frequency series FA (unit wave Wo) of the audio signal XA is reflected in the variation component C. Thus, for example, as the vibrato depth of the audio signal XA increases, an amplitude width (vibrato depth) of the variation component C increases.

If a variable P(ti) indicative of the time point tF (hereinafter referred to as "degree of progression") in the unit wave WC indicated by the shape information S(ti) is introduced, the frequency f(ti) is defined by Mathematical Expression (1) below.

$$f(ti)=IDFT\{S(ti), P(ti)\} \quad (1)$$

The function "IDFT{S(ti), P(ti)}" represents a numerical value (fundamental frequency fO) at the time point tF, designated by the degree of progression P(ti), in the unit wave WC of a time region where the frequency spectrum Q indicated by the shape information S(ti) has been subjected to inverse Fourier transform. Thus, Mathematical Expression (1) above can be expressed by Mathematical Expression (2) below.

$$f(t_i) = \frac{1}{N}\sum_{k=1}^{N} S(t_i)_k \exp\left(\frac{P(t_i)}{N}(k-1)\cdot 2\pi j\right) \quad (2)$$

In Mathematical Expression (2) above, "S(ti)k" indicates a k-th coefficient value of the N coefficient values (i.e., coefficient values of the frequency spectrum Q) constituting the shape information S(ti), and "j" is an imaginary unit.

The degree of progression P(ti) in Mathematical Expressions (1) and (2) can be defined by Mathematical Expression (3) below.

$$P(ti)=\text{mod}\ \{p(ti), N\} \quad (3)$$

The function mod {a, b} in Mathematical Expression (3) represents a remainder obtained by dividing a numerical value "a" by a numerical value "b" (a/b). Further, the variable "p(ti)" in Mathematical Expression (3) corresponds to an integrated value of velocity information V(ti) till a time point (ti−1) immediately before the time point ti and can be expressed by Mathematical Expression (4) below.

$$p(t_i) = \sum_{\tau=0}^{t_{i-1}} V(\tau) \quad (4)$$

As understood from Mathematical Expression (4) above, the value of the variable "p(ti)" increases over time to exceed a predetermined value N. The reason why the variable p(ti) is divided by the predetermined value N is to allow the degree of progression P(ti) to fall at or below the predetermined value N in such a manner that a given time point tF within one unit wave WC (N samples) is designated.

Figure 9:
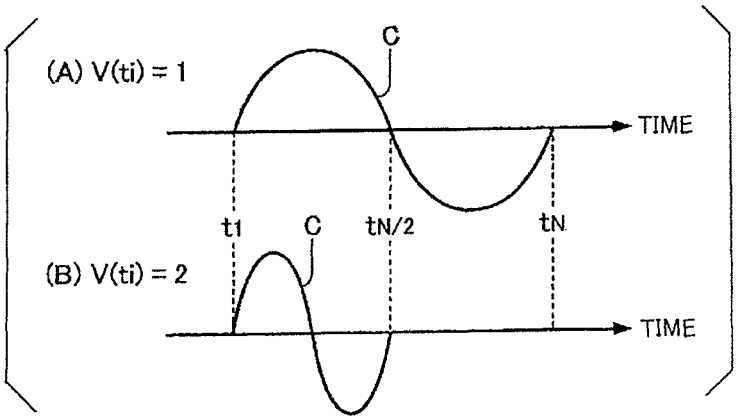
FIG. 9 is a conceptual diagram explanatory of a degree of progression in a unit wave extracted in the audio processing apparatus.

For convenience of description, let it be assumed here that the unit wave WC (N samples) represented by the shape information S(ti) is a sine wave of one cyclic period and that the shape information S(ti) is the same for all of the time points ti (t1, t2, t3, . . . ) If the velocity information V(ti) for each of the time points ti is fixed to a value "1", then the degree of progression P(ti) increases by one at each of the time points ti (like 0, 1, 2, 3, . . . ) from the time point t1 to the time point tN. Thus, of the variation component C, a frequency f(ti) at the time point ti is set at a numerical value of an i-th sample, indicated by the degree of progression P(ti), of the unit wave WC (N samples) represented by the shape information S(ti). Namely, the variation component C constitutes a sine wave having, as one cyclic period, a portion from the time point t1 to the time point tN as shown in (A) of FIG. 9.

If the velocity information V(ti) for each of the time points ti is a value "2", then the degree of progression P(ti) increases by two at each of the time points ti (like 0, 2, 4, 6, . . . ) from the time point t1 to the time point tN/2. Thus, of the variation component C, a frequency f(ti) at the time point ti is set at a numerical value of a 2i-th sample, indicated by the degree of progression P(ti), of the unit wave WC (N samples) represented by the shape information S(ti). Accordingly, the variation component C constitutes a sine wave having, as one cyclic period, a portion from the time point t1 to the time point tN/2 as shown in (B) of FIG. 9. Namely, in the case where the velocity information V(ti) is "2", the cyclic period of the variation component C is set at half the cyclic period in the case where the velocity information V(ti) is "1". As understood from the foregoing, as the velocity information V(ti) increases, the cyclic period of the variation component C becomes shorter, i.e. the vibrato velocity increases. Namely, it can be understood that the frequency f(ti) of the variation component C varies over time with a cyclic period reflecting therein the vibrato velocity of the audio signal XA.

The variation component generation section 42 of FIG. 7 sequentially generates frequencies f(ti) of the variation component C through the aforementioned arithmetic operation of Mathematical Expression (2). Because the velocity information V(ti) can be set at a non-integral number, the degree of progression P(ti) designating a sample of the unit wave WC may sometimes not become an integral number. Thus, in a case where the degree of progression P(ti) in Mathematical Expression (3) is a non-integral number, the variation component generation section 42 interpolates between frequencies f(ti) calculated for integral numbers immediate before and after the degree of progression P(ti) through the arithmetic operation of Mathematical Expression (2), to thereby calculate a frequency f(ti) corresponding to an actual degree of progression P(ti). Namely, the variation component generation section 42 calculates a frequency f(ti) corresponding to the actual degree of progression P(ti), by calculating a frequency f1(*ti*) with a most recent integral number g1, smaller than the degree of progression P(ti) (non-integral number), used as the degree of progression P(ti) in Mathematical Expression (2) and calculating a frequency f2(*ti*) with a most recent integral number g2, greater than the degree of progression P(ti) (non-integral number), used as the degree of progression P(ti) in Mathematical Expression (2) and then interpolating between the thus-calculated frequencies f1(*ti*) and f2(*ti*).

The signal generation section 44 imparts the audio signal XB with the variation component C generated in accordance with the above-described procedure. More specifically, the signal generation section 44 adds the variation component C to the time series of fundamental frequencies extracted from the audio signal XB, and generates an audio signal $X_{OUT}$ having, as fundamental frequencies, a series of numerical values obtained by the addition. Of course, generation of the audio signal $X_{OUT}$, having the variation component C reflected therein, may be performed using any suitable one of the conventionally-known techniques.

In the instant embodiment, as described above, unit information U(ti) (comprising shape information S(ti) and velocity information V(ti)), each indicative of a character of a unit wave WO and corresponding to one cyclic period of a frequency series FA of an audio signal XA, is sequentially generated every time point ti, and a variation component C is generated using each of the unit information U(ti). Thus, the above-described embodiment can generate an audio signal $X_{OUT}$ having a vibrato character of the audio signal XA faithfully and naturally reproduced therein, as compared to the disclosed techniques of patent literature 1 and non-patent literature 1 where a vibrato is approximated with a simple sine wave. More specifically, the above-described embodiment can generate a variation component C, having a vibrato waveform (including a vibrato depth) of the audio signal XA faithfully reflected therein, by applying individual shape information S(ti) of variation information DV, and it can generate a variation component C, having a vibrato velocity of the audio signal XA faithfully reflected therein, by applying individual velocity information V(ti) of the variation information DV.

Note that patent literature 2 (Japanese Patent Application Laid-open Publication No. 2002-73064) identified above discloses a technique for imparting a vibrato to a desired audio signal by use of pitch variation data indicative of a waveform of a vibrato imparted to an actual singing voice. However, with such a technique disclosed in patent literature 2, where vibrato components indicated by the individual pitch variation data differ in phase and time length, a result obtained, for example, by adding together a plurality of the pitch variation data may not become a periodic waveform (i.e., vibrato component). By contrast, the above-described embodiment generates shape information S(ti) after uniformalizing the phases and time lengths of individual unit waves WO extracted from a frequency series FA. Thus, unit waves WC indicated by new shape information S(ti) generated by adding together a plurality of shape information S(ti) present a periodic waveform having characteristics of the original (i.e., non-added-together) individual shape information S(ti) appropriately reflected therein. Namely, the above-described first embodiment, where the phase correction section 52 and time adjustment section 54 adjust unit waves Wo, can advantageously facilitate processing of the shape information S(ti) (i.e., modification of the variation component C). In view of the above-described behavior, there may be suitably employed a modified construction where the variation component generation section 42 adds together a plurality of shape information S(ti) extracted from different audio signals XA to thereby generate new shape information S(ti).

Further, assuming a case where a vibrato component to be imparted to an audio signal in accordance with the technique disclosed in patent literature 2 is changed in time length, and if pitch variation data indicative of a waveform of the vibrato component are merely compressed or expanded in the time axis direction, characteristics of the vibrato component would vary, and thus, complicated arithmetic operations would be required for adjusting the time lengths while suppressing variation of the vibrato component. By contrast, the above-described first embodiment, where unit information U(ti) (shape information S(ti) and velocity information V((ti)) is generated per unit wave Wo, can advantageously facilitate the compression/expansion of the variation component C as compared to the technique disclosed in patent literature 2. More specifically, the above-described embodiment can expand the variation component C, by using common or same shape information S(ti) for generation of frequencies f(ti) of a plurality of time points ti. For example, the above-described embodiment identifies, from shape information S(t1), frequencies f(ti) at individual time points ti from the time point t1 to the time point t4, identifies, from shape information S(t2), frequencies f(ti) at individual time points ti from the time point t5 to the time point t8, and so on. On the other hand, the above-described embodiment may also compress the variation component C by using the shape information S(ti) at predetermined intervals (i.e., while skipping a predetermined number of the shape information S(ti)). For example, every other shape information S(ti) may be used, in which case shape information S(t1) is used for identifying a frequency f(t1) of the time point t1, shape information S(t3) is used for identifying a frequency f(t2) of the time point t2 and shape information S(t5) is used for identifying a frequency f(t3) of the time point t3 (with shape information S(t2) and shape information S(t4) skipped).

B. Second Embodiment

The following describe a second embodiment of the present invention. In the following description, elements similar in function and construction to those in the first embodiment are indicated by the same reference numerals and characters as used for the first embodiment and will not be described here to avoid unnecessary duplication.

In the above-described first embodiment, all coefficient values of a frequency spectrum Q of a unit wave WB are generated as shape information S(ti). However, in the second embodiment, the second generation section 562 generates, as shape information S(ti), a series of a plurality NO (NO<N) of coefficient values within a predetermined low frequency region of a frequency spectrum Q of a unit wave WB. In the arithmetic operation of Mathematical Expression (2) above, the variation component generation section 42 sets the variable S(ti)k of Mathematical Expression (2) to a coefficient value contained in the shape information S(ti) as long as the variable k is within a range equal to and less than the value "NO" and below, but sets the variable S(ti)k of Mathematical Expression (2) to a predetermined value (such as zero) as long as the variable k is within a range exceeding the value "NO".

The second embodiment can achieve the same advantageous results as the first embodiment. Because the character of the unit wave WB appears mainly in a low frequency region of the frequency spectrum Q, it is possible to prevent characteristics of the variation component C, generated by use of the shape information S(ti), from unduly differing from characteristics of the vibrato component of the audio signal XA, although coefficient values in a high frequency region of the frequency spectrum Q are not reflected in the shape information S(ti). Further, the second embodiment, where the number of coefficient values (NO) is smaller than that (N) in the first embodiment (NO<N), can advantageously reduce the capacity of the storage device 24 necessary for storage of individual shape information S(ti) (variation information DV).

C. Modifications

The above-described embodiments of the present invention can be modified variously as exemplified below. Two or more of the modifications exemplified below may be combined as necessary.

(1) Modification 1:

Whereas the embodiments of the present invention have been described above as using the variation information DV, generated by the variation extraction section 30, for generation of the variation component C, the variation information DV may be used for generation of the variation component C after the variation information DV is processed by the variation component generation section 42. For example, it is preferable that the variation component generation section 42 synthesize (e.g., add together) a plurality of shape information S(ti) as set forth above. More specifically, the variation component generation section 42 may, for example, synthesize a plurality of shape information S(ti) generated from audio signals XA of different voice utterers (persons), or synthesize a plurality of shape information S(ti) generated for different time points ti from an audio signal XA of a same voice utterer (person). Further, the variation width (vibrato depth) of the variation component C can be increased or decreased if the individual coefficient values of the shape information S(ti) are adjusted (e.g., multiplied by predetermined values).

(2) Modification 2:

Whereas the embodiments of the present invention have been described above in relation to the case where audio signals XA and XB are supplied from the common or same signal supply device 12, audio signals XA and XB may be in any other desired relationship. For example, audio signals XA and audio signals XB may be obtained from different supply sources. Further, in a case where an audio signal XA is used as an audio signal XB, variation information DV generated from an audio signal XA may be imparted again to the audio signal XA (XB), for example, after the audio signal has been processed. Further, the audio signals XB, which are to be imparted with variation information DV, do not necessary need to exist independently. For example, an audio signal $X_{OUT}$ may be generated by a variation component C corresponding to variation information DV being applied to voice synthesis. In each of the above-described embodiments, as understood from the foregoing, the signal generation section 44 can be comprehended as being a component that generates an audio signal $X_{OUT}$ imparted with a variation component C corresponding to variation information DV and does not necessary need to have a function of synthesizing a variation component C and an audio signal XB that exist independently of each other.

(3) Modification 3:

Whereas each of the above-described embodiments is constructed to perform setting of a virtual phase θ(ti) and generation of unit information U(ti) (i.e., extraction of a unit wave Wo) for each of the time points ti of the fundamental frequency $f_0$ constituting the frequency series FA, a modification of the audio processing apparatus 100 may be constructed to change as desired the period with which the fundamental frequency $f_0$ is extracted from the audio signal XA, the period with which the virtual phase θ(ti) is set and the period with which the unit information U(ti) is generated. For example, extraction of the unit wave Wo and generation of the unit information U(ti) may be performed at intervals of a predetermined (plural) number of the time points ti.

(4) Modification 4:

Whereas each of the embodiments has been described in relation to the case where the time length adjustment is performed by the time adjustment section 54 after the phase correction by the phase correction section 52, the phase correction may be performed by the phase correction section 52 after the time length adjustment by the time adjustment section 54. Further, only one of the phase correction by the phase correction section 52 and time length adjustment by the time adjustment section 54 may be performed, or both of the phase correction by the phase correction section 52 and time length adjustment by the time adjustment section 54 may be dispensed with.

(5) Modification 5:

Whereas each of the embodiments has been described in relation to the audio processing apparatus 100 provided with both the variation extraction section 30 and the variation impartment section 40, a modification of the audio processing apparatus 100 may be provided with only one of the variation extraction section 30 and the variation impartment section 40. For example, there may be employed a modified construction where variation information DV is generated by one audio processing apparatus provided with the variation extraction section 30, and another audio processing apparatus provided with the variation impartment section 40 uses the variation information DV, generated by the one audio processing apparatus, to generate an audio signal $X_{OUT}$. In such a case, the variation information DV is transferred from the one audio processing apparatus (provided with the variation extraction section 30) to the other audio processing apparatus (provided with the variation impartment section 40) via a portable recording or storage medium or a communication network.

(6) Modification 6:

Whereas each of the embodiments has been described above as generating both shape information S(ti) and velocity information V(ti), only one of such shape information S(ti) and velocity information V(ti) may be generated as variation information DV. For example, in the case where generation of velocity information V(ti) is dispensed with, variation information DV can be generated by the arithmetic operation of Mathematical Expression (2) being performed after the velocity information V(ti) in Mathematical Expression (4) is set at a predetermined value (e.g., one). In this way, it is possible to generate variation information DV that reflects therein a shape (e.g., vibrato depth) of a unit wave Wo of an audio signal XA but does not reflect therein a vibrato velocity of the audio signal XA. On the other hand, in the case where generation of shape information S(ti) is dispensed with, variation information DV can be generated by the arithmetic operation of Mathematical Expression (2) being performed after the shape information S(ti) is set at a predetermined wave (e.g., sine wave). In this way, it is possible to generate variation information DV that reflects therein a vibrato velocity of an audio signal XA but does not reflect therein a shape (vibrato depth) of a unit wave Wo of the audio signal XA.

(7) Modification 7:

Whereas each of the embodiments has been described above as extracting, from a frequency series FA, a unit wave Wo corresponding to a portion Θ centering at a virtual phase θ(ti), the method for extracting a unit wave Wo by use of a virtual phase θ(ti) may be modified as appropriate. For example, a portion corresponding to a portion Θ of a 2π width having a virtual phase θ(ti) as an end point (i.e., start or end point) may be extracted as a unit wave Wo from a frequency series FA.

(8) Modification 8:

Further, each of the embodiments is constructed in such a manner that a frequency series FA and frequency series FB are extracted from the audio signal XA. Alternatively, such a frequency series FA and frequency series FB may be extracted, by the phase setting section 34 and unit wave extraction section 36, from a storage medium having the frequency series FA and frequency series FB prestored therein. Namely, the character extraction section 32 may be omitted from the audio processing apparatus 100.

(9) Modification 9:

Whereas each of the embodiments has been described above as generating the variation information DV having reflected therein variation in fundamental frequency $f_0$ of the audio signal XA, the type of a character element for which the variation information DV should be generated is not limited to the fundamental frequency $f_0$. For example, a time series of sound volume levels (sound pressure levels) may be extracted, in place of the frequency series FA, every time point ti of the audio signal XA, so that information DV having reflected therein variation over time of a sound volume of the audio signal XA can be generated. Namely, the basic principles of the present invention may be applied in relation to any desired types of character elements that vary over time.

This application is based on, and claims priority to, JP PA 2009-276470 filed on 4 Dec. 2009. The disclosure of the priority application, in its entirety, including the drawings, claims, and the specification thereof, are incorporated herein by reference.

What is claimed is:

1. An audio processing apparatus comprising:

a phase setting section which sets virtual phases in a time series of character values representing a character element of an audio signal, the virtual phases representing phases of a periodic variation of the time series of character values;

a unit wave extraction section which extracts, from the time series of character values, a plurality of unit waves demarcated in accordance with the virtual phases set by said phase setting section, the unit waves being demarcated from each other cycle by cycle of the periodic variation of the time series of character values; and an information generation section which generates, for each of the unit waves extracted by said unit wave extraction section, unit information indicative of a character of the unit wave.

2. The audio processing apparatus as claimed in claim 1, which further comprises a phase correction section which corrects the phases of the unit waves, extracted by said unit wave extraction section, so that the unit waves are brought into phase with each other, and wherein said information generation section generates the unit information for each of the unit waves having been subjected to phase correction by said phase correction section.

3. The audio processing apparatus as claimed in claim 1, which further comprises a time adjustment section which compresses or expands each of the unit waves extracted by said unit wave extraction section, and wherein said information generation section generates the unit information for each of the unit waves having been subjected to compression or expansion by said time adjustment section.

4. The audio processing apparatus as claimed in claim 3, wherein said information generation section includes a first generation section which, for each of the unit waves, generates, as the unit information, velocity information indicative of a character value variation velocity in the time series of character values in accordance a degree of the compression or expansion by said time adjustment section.

5. The audio processing apparatus as claimed in claim 1, wherein said information generation section includes a second generation section which, for each of the unit waves, generates, as the unit information, shape information indicative of a shape of a frequency spectrum of the unit wave.

6. The audio processing apparatus as claimed in claim 1, wherein the character element of the audio signal is a frequency or a sound volume.

7. The audio processing apparatus as claimed in claim 1, which further comprises a storage section which stores a set of a plurality of the unit information generated by said information generation section for individual ones of the unit waves.

8. The audio processing apparatus as claimed in claim 7, which further comprises:

a variation component generation section which generates a variation component, corresponding to the time series of character values, from the set of the unit information stored in said storage section;

a signal supply section which supplies an audio signal; and a signal generation section which imparts the variation component, generated by the variation component generation section, to a character element of the supplied audio signal.

9. A computer-implemented method for processing an audio signal, said method comprising:

a step of setting virtual phases in a time series of character values representing a character element of an audio signal, the virtual phases representing phases of a periodic variation of the time series of character values;

a step of extracting, from the time series of character values, a plurality of unit waves demarcated in accordance with the virtual phases set by said step of setting, the unit waves being demarcated from each other cycle by cycle of the periodic variation of the time series of character values; and a step of generating, for each of the unit waves extracted by said step of extracting, unit information indicative of a character of the unit wave.

10. A computer-readable medium storing a program for causing a processor to perform a method for processing an audio signal, said method comprising the steps of:

setting virtual phases in a time series of character values representing a character element of an audio signal, the virtual phases representing phases of a periodic variation of the time series of character values;

extracting, from the time series of character values, a plurality of unit waves demarcated in accordance with the virtual phases set by said step of setting, the unit waves being demarcated from each other cycle by cycle of the periodic variation of the time series of character values; and generating, for each of the unit waves extracted by said step of extracting, unit information indicative of a character of the unit wave.

11. An audio processing apparatus comprising:

a storage section which stores a set of a plurality of unit information indicative of respective characters of a plurality of unit waves extracted from a time series of character values, representing a character element of an audio signal, in accordance with virtual phases set in the time series, the virtual phases representing phases of a periodic variation of the time series of character values, the unit waves being demarcated from each other cycle by cycle of the periodic variation of the time series of character values, the unit information each including velocity information to be used for control to compress or expand a time length of a corresponding one of the unit waves, and shape information indicative of a shape of a frequency spectrum of the corresponding unit wave;

a variation component generation section which generates a variation component, corresponding to the time series of character values, from the set of the unit information stored in said storage section; and a signal generation section which impart the variation component, generated by said variation component generation section, to a character element of an input audio signal.

12. A computer-implemented method for processing an audio signal, said method comprising:

a step of accessing a storage section which stores a set of a plurality of unit information indicative of respective characters of a plurality of unit waves extracted from a time series of character values, representing a character element of an audio signal, in accordance with virtual phases set in the time series, the virtual phases representing phases of a periodic variation of the time series of character values, the unit waves being demarcated from each other cycle by cycle of the periodic variation of the time series of character values, the unit information each including velocity information to be used for control to compress or expand a time length of a corresponding one of the unit waves, and shape information indicative of a shape of a frequency spectrum of the corresponding unit wave;

a step of generating a variation component, corresponding to the time series of character values, from the set of the unit information stored in said storage section; and a step of imparting the generated variation component to a character element of an input audio signal.

13. A computer-readable medium storing a program for causing a processor to perform a method for processing an audio signal, said method comprising the steps of:

accessing a storage section which stores a set of a plurality of unit information indicative of respective characters of a plurality of unit waves extracted from a time series of character values, representing a character element of an audio signal, in accordance with virtual phases set in the time series, the virtual phases representing phases of a periodic variation of the time series of character values, the unit waves being demarcated from each other cycle by cycle of the periodic variation of the time series of character values, the unit information each including velocity information to be used for control to compress or expand a time length of a corresponding one of the unit waves, and shape information indicative of a shape of a frequency spectrum of the corresponding unit wave;

generating a variation component, corresponding to the time series of character values, from the set of the unit information stored in said storage section; and imparting the generated variation component to a character element of an input audio signal.

* * * * *